US009794666B1

(12) United States Patent
Beverly

(10) Patent No.: US 9,794,666 B1
(45) Date of Patent: Oct. 17, 2017

(54) MINIATURE VOICE COIL HAVING HELICAL LEAD-OUT FOR ELECTRO-ACOUSTIC TRANSDUCER

(71) Applicant: Bose Corporation, Framingham, MA (US)

(72) Inventor: David W. Beverly, Lunenburg, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/181,989

(22) Filed: Jun. 14, 2016

(51) Int. Cl.

| | |
|---|---|
| ***H04R 1/00*** | (2006.01) |
| ***H04R 1/06*** | (2006.01) |
| ***H04R 9/06*** | (2006.01) |
| ***H04R 31/00*** | (2006.01) |

(52) U.S. Cl.
CPC ..... *H04R 1/06* (2013.01); *H04R 9/06* (2013.01); *H04R 31/006* (2013.01)

(58) Field of Classification Search
CPC ... H04R 1/06; H04R 9/02; H04R 9/06; H04R 9/045; H04R 9/046; H04R 31/006
USPC ..... 381/400, 407, 409, 410
See application file for complete search history.

(56) References Cited

U.S. PATENT DOCUMENTS

| | | | | |
|---|---|---|---|---|
| 3,590,170 | A * | 6/1971 | Sawyer | H04R 9/046 29/595 |
| 3,828,144 | A | 8/1974 | Yamamuro et al. | |
| 3,963,882 | A | 6/1976 | Lewis | |
| 4,225,757 | A * | 9/1980 | Babb | H04R 7/122 181/165 |
| 6,243,472 | B1 | 6/2001 | Bilan et al. | |
| 6,691,832 | B2 | 2/2004 | Moritake et al. | |
| 8,107,665 | B2 | 1/2012 | Haapapuro et al. | |
| 8,155,374 | B2 | 4/2012 | Yuasa et al. | |
| 8,180,097 | B2 | 5/2012 | Harms et al. | |
| 8,391,538 | B2 | 3/2013 | Chiu et al. | |
| 2004/0197004 | A1* | 10/2004 | Suzuki | H04R 1/06 381/407 |

(Continued)

FOREIGN PATENT DOCUMENTS

| | | |
|---|---|---|
| EP | 2563042 A1 | 2/2013 |
| EP | 2892248 A1 | 7/2015 |

(Continued)

OTHER PUBLICATIONS

International Search Report & Written Opinion in International Patent Application No. PCT/US17/35157, dated Jul. 14, 2017; 9 pages.

*Primary Examiner* — Brian Ensey
(74) *Attorney, Agent, or Firm* — Schmeiser, Olsen & Watts LLP

(57) ABSTRACT

An electro-acoustic driver comprises a sleeve having a first end and a second end; a first wire exit opening at a first position of the sleeve; a second wire exit opening at a second position of the sleeve; a voice coil within the sleeve; a magnetic assembly in magnetic communication with the voice coil in the sleeve between the first end and the second end; and a conductive wire of the voice coil having a first region at the first wire exit opening, a second region at the voice coil, and a third region between the first and second regions configured as a helix about the acoustic assembly. The third region of the conductive wire is substantially unsupported between the voice coil and the first wire exit opening.

26 Claims, 9 Drawing Sheets

(56) References Cited

U.S. PATENT DOCUMENTS

| | | | |
|---|---|---|---|
| 2012/0183169 | A1 | 7/2012 | Yang |
| 2012/0292401 | A1 | 11/2012 | Mahalingam et al. |

FOREIGN PATENT DOCUMENTS

| | | | | | |
|---|---|---|---|---|---|
| FR | 1400579 | A | | 5/1965 | |
| GB | 776280 | | | 6/1957 | |
| JP | 61139196 | A | * | 6/1986 | ..... H04R 9/04 |
| JP | H08251693 | A | | 9/1996 | |
| JP | 3098127 | | | 10/2000 | |
| JP | 2003153382 | | | 5/2003 | |
| JP | 3531257 | | | 5/2004 | |
| JP | 4575515 | | | 11/2010 | |
| JP | 4594858 | | | 12/2010 | |
| JP | 4820916 | | | 11/2011 | |
| KR | 100817743 | | | 3/2008 | |
| KR | 101077569 | | | 10/2011 | |

* cited by examiner

MINIATURE VOICE COIL HAVING HELICAL LEAD-OUT FOR ELECTRO-ACOUSTIC TRANSDUCER

BACKGROUND

This description relates generally to transducers for headphones, and more specifically, voice coil lead-out configurations of a miniature electro-acoustic transducer.

BRIEF SUMMARY

In accordance with one aspect, an electro-acoustic driver comprises a sleeve having a first end and a second end; a first wire exit opening at a first position of the sleeve; a second wire exit opening at a second position of the sleeve; a voice coil within the sleeve; a magnetic assembly in magnetic communication with the voice coil in the sleeve between the first end and the second end; and a conductive wire of the voice coil having a first region at the first wire exit opening, a second region at the voice coil, and a third region between the first and second regions configured as a helix about the acoustic assembly. The third region of the conductive wire is substantially unsupported between the voice coil and the first wire exit opening.

Aspects may include one or more of the following features:

The electro-acoustic driver may further comprise a diaphragm covering the first end of the sleeve. The acoustic assembly may include a bobbin in communication with the diaphragm; and a third region of the voice coil conductive wire about the bobbin in the sleeve.

The first and second regions of the conductive wire may be above the voice coil in the sleeve.

The first wire exit recess and the second exit wire recess may be 180 degrees from each other such that the first region and the second region of the conductive wire extend along a same axis.

The sleeve and the acoustic assembly may be positioned about an axis. The sleeve may be constructed for rotation about the axis to form the helix.

The first and second regions may be unsupported from the third region of the voice coil conductive wire to the sleeve.

The first region of the voice coil conductive wire may include a first point, a second point, and a third point. The third point may be at the first wire exit recess. The first region may be helical from the first point to the third point, and linear from the third point to the second point. The second region of the voice coil conductive wire includes a first point, a second point, and a third point. The third point is at the second wire exit recess. The second region may be helical from the first point to the third point, and linear from the third point to the second point.

One of the first and second regions of the conductive wire may include a bend such that the one of the first and second regions extends in along a helical path in a different direction than that of the other of the first and second regions.

In accordance with one aspect, an electro-acoustic driver comprises a sleeve having a first end and a second end; a voice coil within the sleeve; a magnetic assembly in magnetic communication with the voice coil in the sleeve between the first end and the second end; a mandrel element about a portion of the magnetic assembly; and a conductive wire extending from the voice coil. The conductive wire is substantially (a) in the shape of a helix between the voice coil and the mandrel element, and (b) unsupported between the voice coil and the mandrel element.

Aspects may include one or more of the following features:

The electro-acoustic driver may further comprise a diaphragm covering the first end of the sleeve. The acoustic assembly may include a bobbin in communication with the diaphragm and the voice coil may include a third region about the bobbin in the sleeve.

The first and second regions of the conductive wire may be below the voice coil in the sleeve.

The acoustic assembly may include a back plate having a first opening for receiving the first region of the conductive wire and a second opening for receiving the second region of the conductive wire.

The electro-acoustic driver may further comprise a circuit board coupled to the second end of the sleeve. The first and second regions of the conductive wire may extend to the circuit board.

The first and second regions may be unsupported from the third region of the voice coil conductive wire to the mandrel element.

The first region of the voice coil conductive wire may include a first point, a second point, and a third point, wherein the third point is at the mandrel element. The first region may be helical from the first point to the third point, and linear from the third point to the second point. The second region of the voice coil conductive wire may include a first point, a second point, and a third point. The third point may be at the mandrel element. The second region may be helical from the first point to the third point, and linear from the third point to the second point.

In another aspect, a method for assembling an electro-acoustic driver, comprises positioning a voice coil within a sleeve, the sleeve including a first wire exit opening at a first position of a sleeve and a second wire exit opening at a second position of the sleeve; positioning a magnetic assembly in the sleeve between the first end and the second end; and arranging a conductive wire of the voice coil as a helix about the magnetic assembly between the voice coil and the first wire exit opening. The helical conductive wire is substantially unsupported between the voice coil and the first wire exit opening.

Aspects may include one or more of the following features:

The first wire exit recess and the wire exit recess may be 180 degrees from each other at the first end of the sleeve.

Arranging the conductive wire about the acoustic assembly may comprise rotating the sleeve to a predetermined position relative to the voice coil in a first direction about an axis along which the sleeve extends; and forming the helix from the conductive wire in response to rotating the sleeve.

The first and second regions may be at the predetermined position, and wherein the method further comprises: rotating the sleeve past the predetermined position so that the first and second regions of the conductive wire each extends tangentially relative to the sleeve.

The method may further comprise rotating the sleeve in a second direction opposite the first direction until the first and second regions are at the predetermined position.

After rotating the sleeve in the second direction may include rotating the sleeve at a smaller amount of rotation than a rotation of the sleeve in the first direction.

The first and second regions may be at a first angle relative to the sleeve when extended tangentially relative to the sleeve. The first and second regions may be at a second angle greater than the first angle when the first and second regions are at the predetermined position.

The first and second regions may be co-linear at the predetermined position.

The method may further comprise coupling an alignment tool to the second end of the sleeve; and holding the alignment tool in a stationary position and rotating the sleeve about the stationary alignment tool.

In another aspect, a method for forming an electro-acoustic driver comprises positioning a voice coil within a sleeve; positioning a magnetic assembly including a mandrel element in the sleeve between a first end and a second end of the sleeve; and arranging a conductive wire of the voice coil as a helix about the magnetic assembly between the voice coil and the mandrel.

Aspects may include one or more of the following features:

Arranging the conductive wire of the voice coil as a helix may include translating the acoustic assembly in a direction of the voice coil in the sleeve; and rotating the acoustic assembly to form the helix.

BRIEF DESCRIPTION

The above and further advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Modern in-ear headphones or earbuds typically include a microspeaker, also referred to as a miniature electro-acoustic transducer or driver, attached to a diaphragm. A voice coil drives the diaphragm to vibrate. In doing so, the diaphragm pushes the air around it, which in turn creates a sound that is output to a user.

A typical voice coil is configured to receive electrical signals from a printed circuit board (PCB) via contacts or terminals by electrically connecting leads wires thereof to the contacts or terminals. To achieve this, a typical voice coil used in a miniature speaker, or microspeaker, includes lead-outs that extend from the voice coil to the contacts or terminals at the transducer sleeve, which in turn are conductively connected directly or indirectly to the PCB.

The formation of a conventional miniature voice coil and the constraining of voice coil wire in the housing, or sleeve, in an earbud transducer is difficult, and requires complicated tooling and manufacturing procedures. In particular, in order for the lead-outs of the conductive wires to extend from the voice coil for attachment to a circuit board or the like, the region of coil wire between the voice coil windings and sleeve wall is typically supported by intermediate wire bonding points at the diaphragm or surround, requiring additional complexity in the assembly process.

Figure 1A:
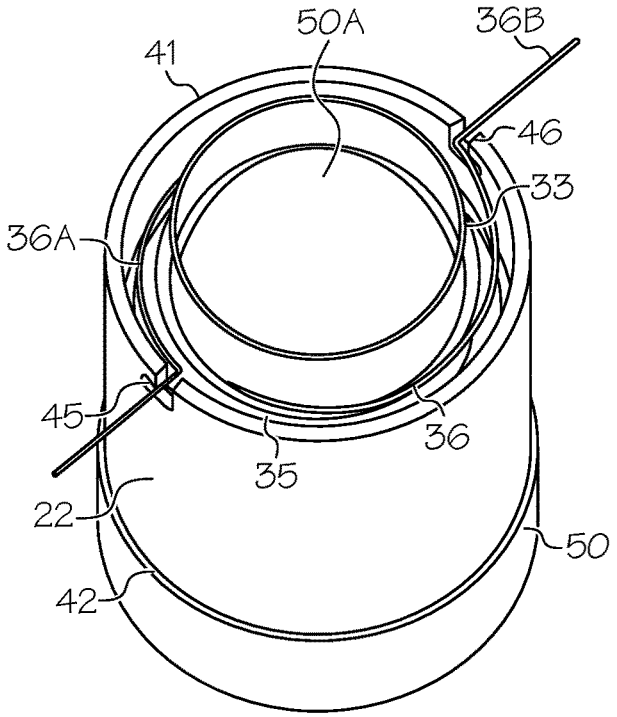
FIG. 1A is a perspective view of an electro-acoustic transducer and an alignment tool, according to some examples.
Figure 1B:
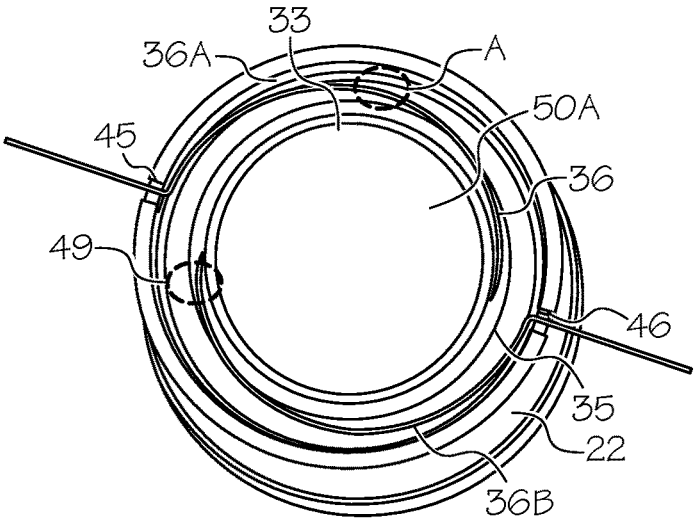
FIG. 1B is a top view of the electro-acoustic transducer and alignment tool of FIG. 1A.
Figure 1C:
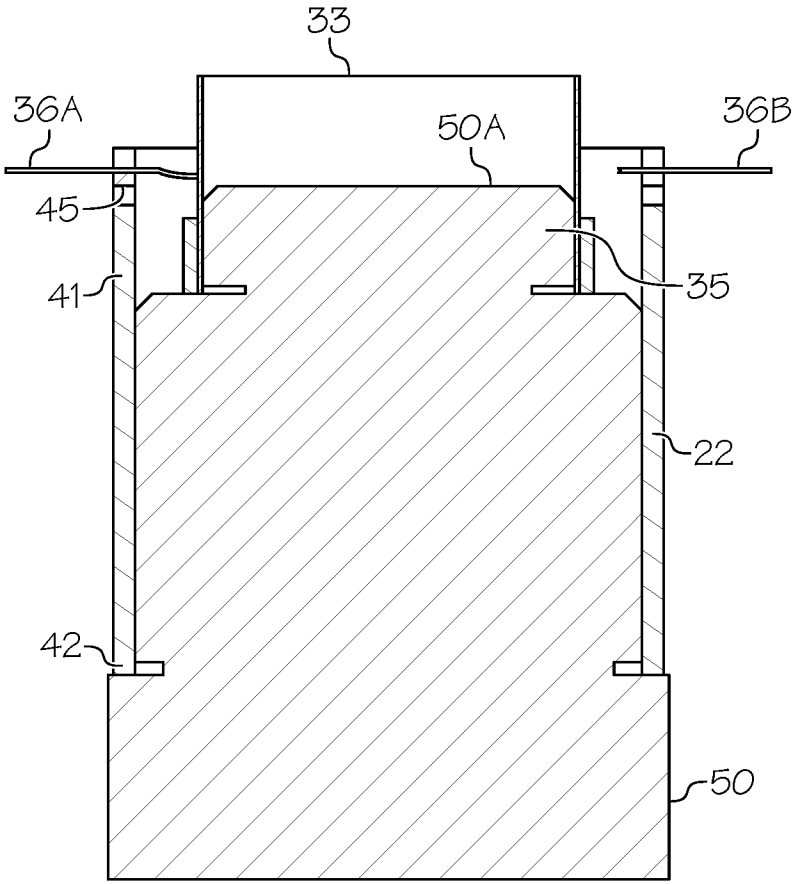
FIG. 1C is a cross-sectional front view of the electro-acoustic transducer and alignment tool of FIGS. 1A and 1B.

Referring to FIGS. 1A-1C, an electro-acoustic transducer 20 comprises a miniature voice coil 35 comprising a pair of helical lead-out regions 36A, B at the ends of a conductive voice coil wire. The electro-acoustic transducer 20 may also include but not be limited to a sleeve 22, a magnet assembly (not shown in FIGS. 1A-1C), and a bobbin 33. The bobbin 33 may be coupled to a diaphragm (not shown) positioned about an opening or cavity of the sleeve 22. The sleeve 22 may have a first end 41 and a second end 42. The diaphragm may be positioned at or near the first end 41. A printed circuit board (PCB) or related noise reduction circuit (not shown) may be positioned at or near the second end 42 of the sleeve 22 opposite the first end 41.

The voice coil 35 includes a conductive main body 36 configured as a winding positioned about the bobbin 33 and an acoustic assembly comprising the magnet 32 and a back plate (not shown). The voice coil main body 36 may be formed of copper or and/other conductive material. The ends of the main body 36 include a first lead-out end region 36A and a second lead-out end region 36B, which are constructed and arranged to provide electrical connections to the voice coil 35. The electrical connections provided by the lead-out regions 36*a, b* allow for acceptance of electrical signals or may be imparted through the PCB or the like (not shown). The electrical signals provided to the coil 35 allow the diaphragm to move inward or outward relative to the acoustic assembly, in particular, the magnet 32.

The first and second lead-out end regions 36A, 34B may extend tangentially from the voice coil 35 in a direction away from the bobbin 33. The lead-out end regions 36*a, b* are constructed and arranged to extend from the sleeve 22 via openings, recesses, or slots, referred to as wire exit recesses 45, 46, in the sleeve 22 for attachment to a circuit board or other connector constructed for receiving input signals. The lead-out ends 36A, B are not bonded to the diaphragm or surround, but instead extend from the main body 36 to the wire exit recesses 45, 46, respectively in an unattached, unsupported and uninterrupted manner. The voice coil main body 36 is positioned about the bobbin 33. During an assembly procedure the main body 36 is unsupported, i.e., not coupled to a fixture or other element, between the voice coil 35 and the sleeve 22 in view of the soft surround or peripheral portion of the diaphragm bonded at the first end 41 of the sleeve 22.

The first and second lead-out regions 36*a, b* of the conductive main body 36 are preferably above the voice coil 35 in the sleeve 22. The first wire exit recess 45 is constructed and arranged at or near the first end 41 of the sleeve 22 to receive the first lead-out end region 36A of the voice coil main body 36. The second wire exit recess 46 is constructed and arranged at or near the first end 41 of the sleeve 22 to receive the second lead-out end region 36B of the voice coil main body 36. The first and second wire exit recesses 45, 46 may be spaced apart in a freely suspended manner 180 degrees, i.e., not bonded to the surround but instead occupying a space between the voice coil 35 and the first end 41 of the sleeve 22. Accordingly, the first lead-out region 36A and the second lead-out region 36B of the conductive wire may extend along a same axis, but not limited thereto. In some examples, the wire exit recesses 45, 46 may be spaced apart 90 degrees, 120 degrees, 150 degrees, and so on about the circumference of the first end 41 of the sleeve 22.

As shown in FIG. 1B, the second lead-out end region 36B includes a bend 49. In particular, the voice coil main body 36 may include insulated wiring that is arranged in multiple layers. The layers of wiring may be configured so that the wiring of the first lead-out end region 36A and the second lead-out end region 36B extend in a same direction about the bobbin 33. However, the bend 49 is formed so that the second lead-out end region 36B does not contact the first lead-out end region 36B between the recesses 45 and 46, for example, at location A. In other words, if the bend 49 was not formed in this manner, then the second lead-out end region 36B would extend along a helical path from location 49 to location A where an undesirable overlap and electrical contact may occur between the regions 36A, 36B. To overcome this, the bend 49 is formed so that the second lead-out end region 36B "reverses direction," and extends along a helical path from location 49 to recess 46 (along the bottom half of the voice coil).

As part of an assembly, an alignment tool 50 can be positioned at the second end 42 of the sleeve 22 for forming a helix from the voice coil lead-outs 36*a, b*. The alignment tool 50 in inserted in the sleeve, and includes a top region 50A that is positioned in the voice coil 35 and bobbin 33. During assembly and formation of the helical voice coil main body 36 in the sleeve 22, the alignment tool 50 may be held in a stationary position, while the sleeve 22 is rotated about the stationary alignment tool 50. Accordingly, the bobbin 33 may function as a mandrel as part of the helix formation, as shown in FIGS. 1A-1C. The alignment tool 50 may include slots 51 for receiving an optional separate tool to force or otherwise separate the bobbin 33 from the tool 50.

Figure 2:
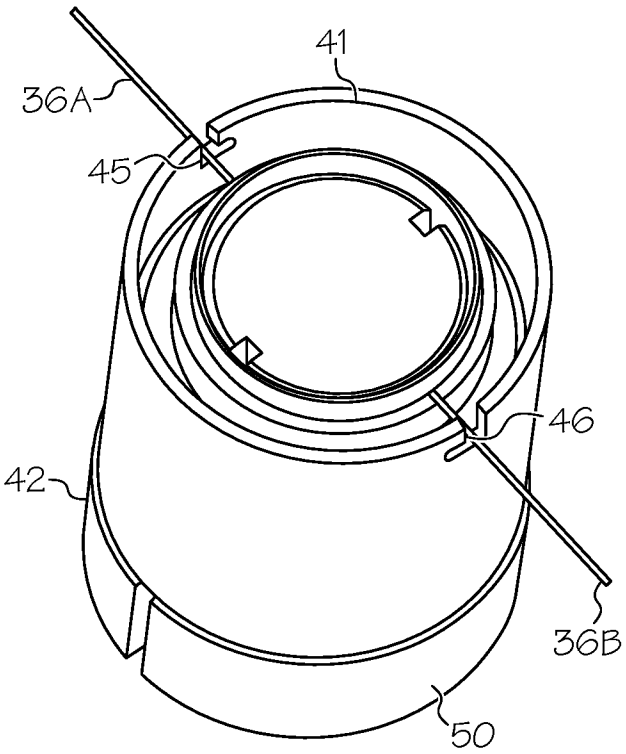
FIGS. 2-5 are views of method steps for assembling an electro-acoustic transducer having a helical lead-out, in accordance with some examples.
Figure 3:
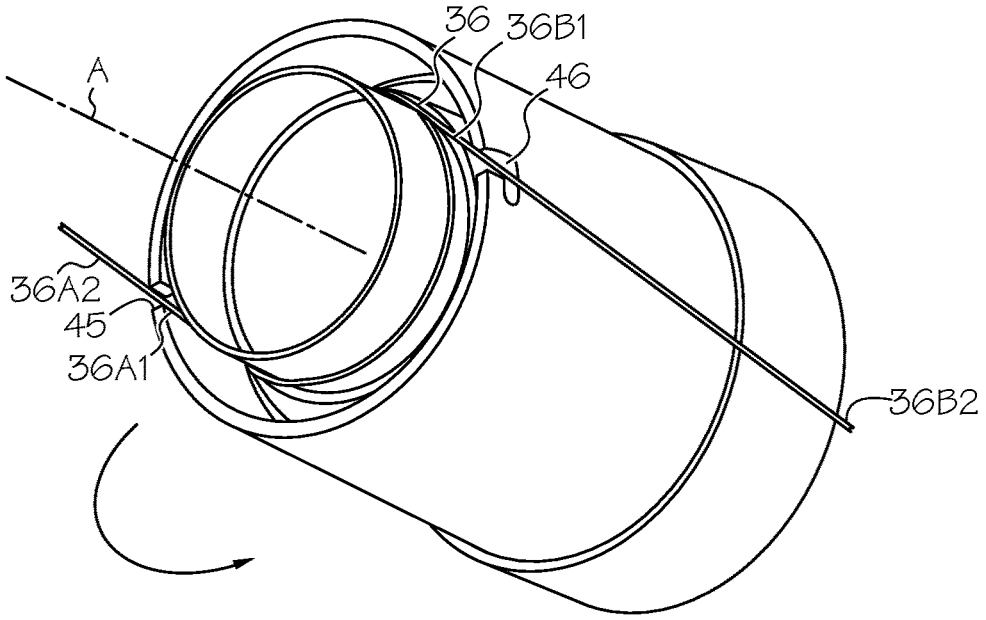
Figure 4:
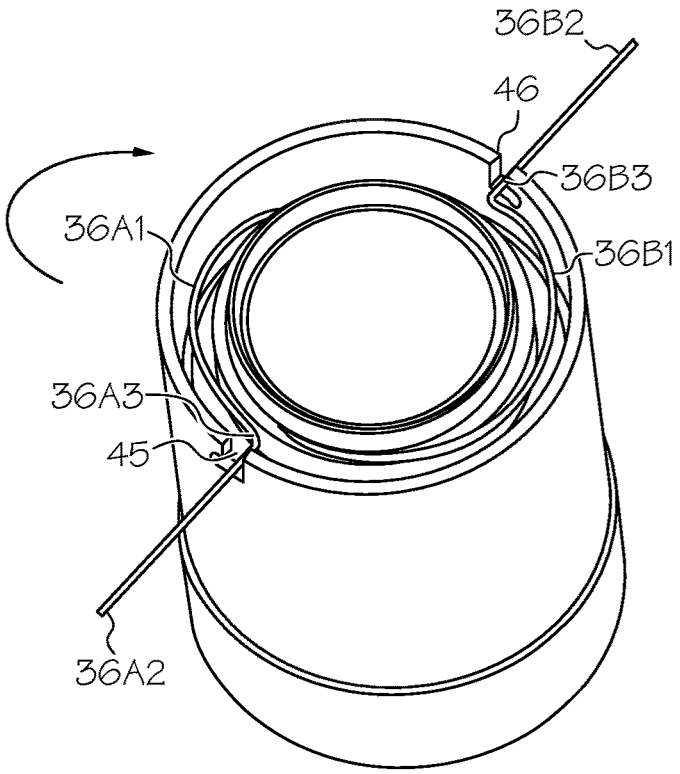

During assembly of the electro-acoustic transducer 20 shown in FIGS. 2-4, the voice coil 35 is inserted in the sleeve 22. The speaker voice coil 35 may include the coil main body 36 formed with spiral-winding of wire of a desired diameter and having the lead-out wire regions 36A, B. The first lead-out region 36A is positioned in the first wire exit recess 45. The second lead-out region 36B is positioned in the second wire exit recess 46. Prior to rotation, the lead-out regions 36A, B extend perpendicular from the sleeve 22. In doing so, as shown in FIG. 3, the sleeve 22 can rotate about the voice coil 35, both of which are centered at a longitudinal axis (A). The sleeve 22 rotates about the axis (A), for example, in a counterclockwise direction. The amount of rotation is predetermined, for example, 180 degrees, but not limited thereto. Here, the voice coil is tacked to the bobbin 33, and the voice coil wire is placed in the sleeve slots 45, 46 respectively so that during rotation the wire is formed as a helix that includes a plurality of windings about the bobbin 33. The helix angle of each helix winding and the number of windings are predetermined. As rotation occurs, the extension of the lead-out regions 36A, B changes so that the lead-out regions 36A, B extend tangentially from the sleeve 22.

However, the sleeve 22 may be over-rotated, over-clocked, or otherwise rotated past a predetermined position, for example, more than 180 degrees from the original position shown in FIG. 2. The rotation of the sleeve 22 in this manner causes the lead-out wire regions 36A, B to extend tangentially from the sleeve 22 due to their positions in the first and second wire exit recesses 45, 46, respectively, as distinguished from extending perpendicularly from the sleeve 22 if not over-rotated. In particular, the first lead-out wire region 36A may extend in a linear direction from a first point 36A1 proximal the coil main body 36 to a second point 36A2 external to the sleeve 22. Similarly, the second lead-out wire region 36B may extend in a linear direction from a first point 36B1 proximal the coil main body 36 to a second point 36B2 external to the sleeve 22.

As shown in FIG. 4, the sleeve can be rotated in an opposite direction, for example, counterclockwise, until the first and second lead-out wire regions 36A, B extend perpendicularly from the sleeve 22, and are at or near 180 degrees relative to each other or other predetermined position. In doing so, the first lead-out wire region 36A is no longer linear from the first point 36A1 to the second point 36A2. Instead, the helix of the coil main body 36 is formed from the first lead out region 36A from the first point 36A1 to a third point 36A3 at the first wire exit recess 45. The first lead-out wire region 36A then extends linearly from the third point 36A3 at the first wire exit region 45 to the second point 36A2. Thus, the linear portion from the second point 36A2 to the third point 36A3 may be at an angle relative to the helical portion from the first point 36A1 to the second point 36A2.

Similarly, the second lead-out wire region 36B is not linear from the first point 36B1 to the second point 36B2. Instead, the helix of the coil main body 36 extends to form the second lead-out wire region 36B from the first point 36B1 to a third point 36B3 at the second wire exit recess 46. The first lead-out wire region 36A extends linearly from the third point 36B3 at the second wire exit recess 46 to the second point 36B2. Thus, the linear portion from the second point 36B2 to the third point 36B3 may be at an angle relative to the helical portion from the first point 36B1 to the second point 36B2. The first lead-out region 36A and the second lead-out region 36B of the conductive wire can extend substantially along a same axis, i.e., co-linear.

Figure 5:
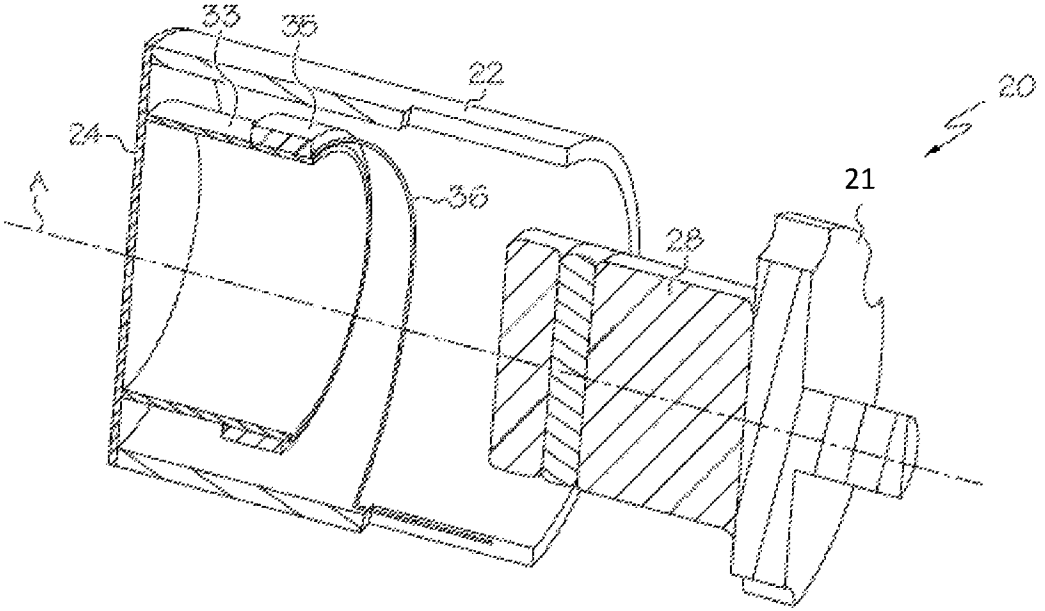

After the helical lead-out wire regions 36A, B are formed, the alignment tool 50 may be removed from the sleeve 50, for example, with the assistance of an external tool (not shown) inserted in a slot 51 in the alignment tool 50. As shown in FIG. 5, a motor assembly 28, for example, including a magnet and back plate, may be inserted into the sleeve 22 to complete the assembly of the electro-acoustic transducer 20.

FIGS. 6-9 illustrate another electro-acoustic transducer 200 having a miniature voice coil 35.

The electro-acoustic transducer 200 shown by way of example in FIGS. 6-9 may include but not be limited to a sleeve 22, a bobbin 33, a motor assembly 28, and the voice coil 35 about the bobbin 33, which may be similar to those counterpart elements of the electro-acoustic transducer 20 of FIGS. 1A-5. Details thereof are not repeated due to brevity. The motor assembly 28 may include a back plate 21, magnet 32, and alignment element 38, and may be the same as or similar to the acoustic assembly illustrated and described with respect to FIGS. 1A-5.

Figure 6:
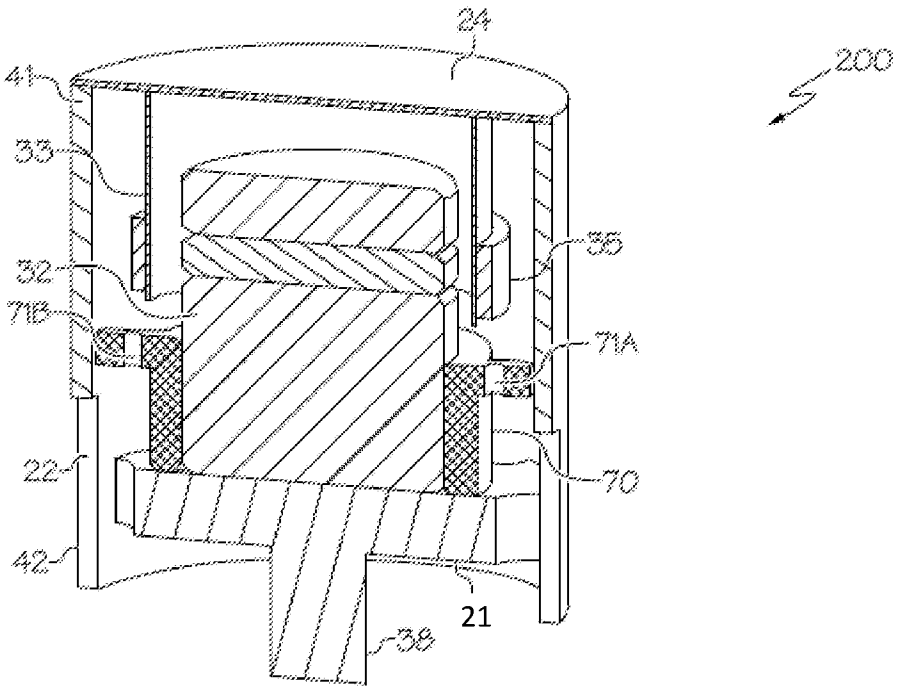
FIG. 6 is a cutaway perspective view of an electro-acoustic transducer, in accordance with other examples.

The electro-acoustic transducer 200 includes a mandrel element 70, also referred to as a lead-out forming element, positioned about a portion of the acoustic assembly, for example, the magnet assembly 32. The mandrel element 70 may also be part of the acoustic assembly, as shown in FIG. 6. The mandrel element 70 includes two or more holes 71A, B (generally, 71) for receiving first and second lead-out wire regions 236A, B, respectively.

The mandrel element 70 aids in the formation of a voice coil helix, or more specifically, helical lead-out wire regions 236A, B. In an assembly operation, a diaphragm 24, bobbin 33, and voice coil 35 are positioned at a first end 41 of the sleeve 22. The voice coil 35 includes lead-out wire regions 236A and 236B extending from the main body 236 of the voice coil 35, which extend from the voice coil 35 in a direction of the second end 42 of the sleeve 22. The bobbin 33 may be coupled to a diaphragm 24 positioned about an opening or cavity at the first end 41 of the sleeve 22. A printed circuit board (PCB) (not shown) or the like may be positioned at the second end 42 of the sleeve 22 opposite the first end 41.

Prior to introduction of the mandrel element 70 and formation of the helix formed of the voice coil main body 36, the lead-outs 236A, B extend longitudinally from the second end of 42 of the sleeve 22. The lead-outs 236A, B may subsequently be coupled to the mandrel element 70 which in turn is part of the acoustic assembly to be inserted in the sleeve 22. For example, a first helical lead-out 236A may be positioned at first mandrel hole 71A, and a second helical lead-out 236B may be positioned at second mandrel hole 71B.

Figure 7:
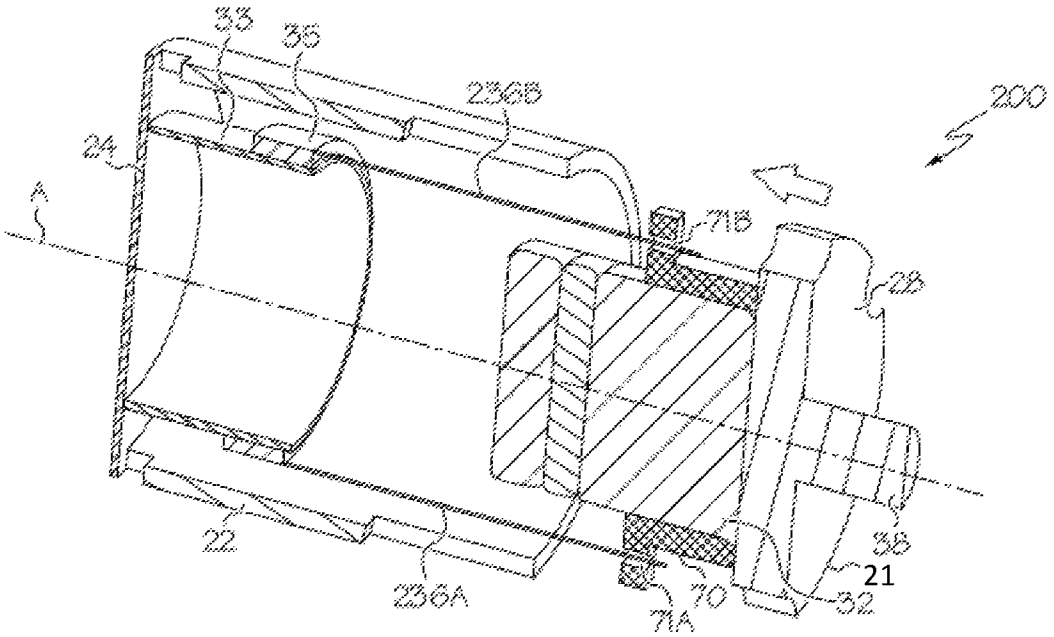
FIGS. 7-9 are views of method steps for assembling the electro-acoustic transducer of FIG. 6, in accordance with some examples.
Figure 8:
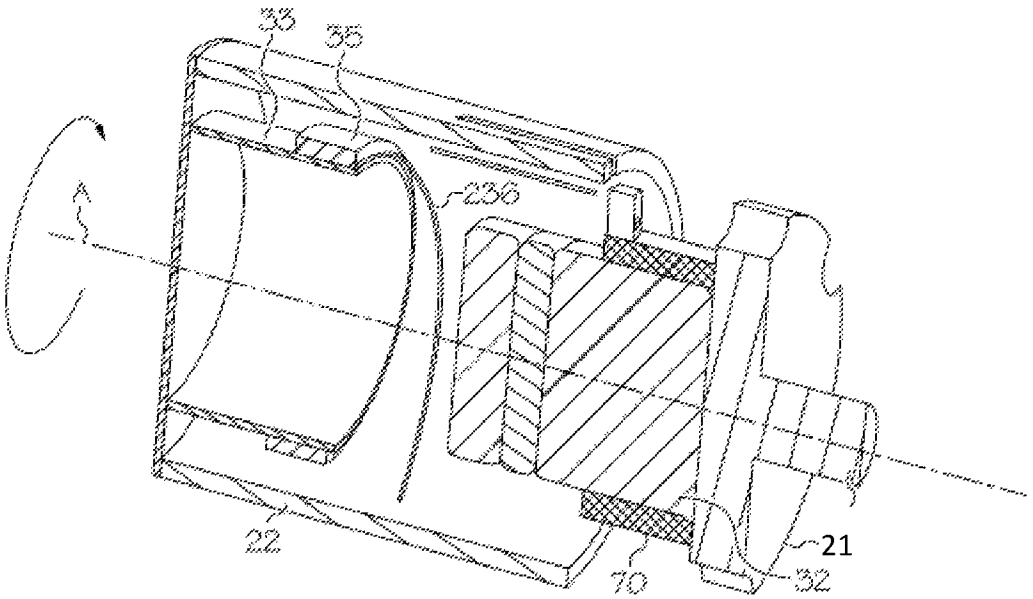
Figure 9:
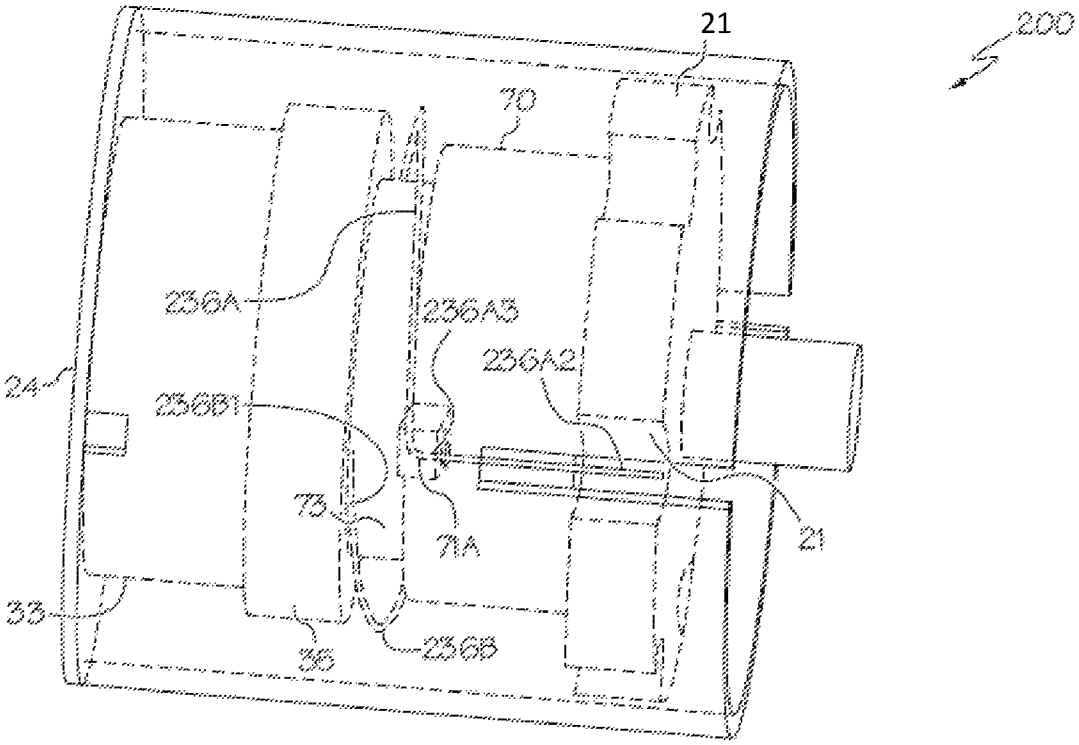

The motor assembly 28 is positioned along a longitudinal axis (A), and held in place by the alignment element 38. The alignment element 38 prevents the motor assembly 28 from rotating while the sleeve 22 rotates about the assembly. The motor assembly 28 is translated in a linear direction toward the voice coil 35 (shown in FIG. 7). As shown in FIG. 8, a helix is formed by the voice coil wiring 236 about the bobbin 33, as shown in FIG. 7. As shown in FIG. 9, the assembled transducer 200 includes a gap 73 between the mandrel element 70 and the voice coil 35. The helix is positioned in the gap 73 and extends about the portion of the magnet 32 exposed by the gap.

More specifically, the helix of the coil main body 36 extends to form a first lead out region 236A extending helically from a first point (not shown) to a third point 236A3 at the first mandrel hole 71A. The helical first lead-out region 236A is unsupported, i.e., not coupled to any other structural elements, between the voice coil 35 and the mandrel element 70. The first lead-out wire region 236A then extends linearly from the third point 236A3 at the first mandrel hole 71A to the second point 236A2 at a back plate opening 21, which in some examples may also function as an acoustic vent. Although not shown, the first lead-out wire region 236A may extend through the back plate 20 to a connection location external to the transducer 200.

Similarly, a helix of the coil main body 36 extends to form the second lead-out wire region 236B from a first point 236B1 to a third point at the mandrel hole 71B (not shown in FIG. 7; see FIG. 5). The helical second lead-out region 236B is unsupported, i.e., not coupled to any other structural elements, between the voice coil 35 and the mandrel element 70. The second lead-out wire region 236B extends linearly from the third point (not shown) at the mandrel hole 71B to a second point (not shown) at a back plate opening (not shown). Although not shown, the second lead-out wire region 236B may extend through the back plate 20 to a connection location external to the transducer 200. Thus, linear sections of the first lead-out region 236A and the second lead-out region 236B of the conductive wire through the back plate openings 21 may be parallel. The linear sections of the first lead-out region 236A and the second lead-out region 236B may also extend to the PCB, and/or through openings in a PCB (not shown) or the like coupled to the second end 42 of the sleeve 22.

In some examples where the magnet 32 is positioned inside the voice coil 35, as shown in the different examples of FIGS. 5 and 6, the outside diameter of the sleeve 22 is less than about 8 mm. In some examples, the sleeve 22 has an outside diameter that is less than about 4.5 mm. In other examples, the sleeve 22 has an outside diameter that is between about 3.0 mm and 4.5 mm. In other examples, the sleeve 22 has an outside diameter that is between about 3.3 mm and 4.2 mm. In other examples, the sleeve 22 has an outside diameter that is between about 3.6 mm and 3.9 mm. In some examples, the magnet 32 has a diameter that is between about 1.5 mm and 4.5 mm. In other examples, the magnet 32 has a diameter that is between about 2.0 mm and 4.0 mm. In other examples, the magnet 32 has a diameter that is between about 2.5 mm and 3.5 mm. In some examples, a ratio of the radiating area to total cross sectional area of the driver is about 0.7. In some examples, a ratio of the radiating area to total cross sectional area of the driver is between 0.57-0.7. In some examples, a ratio of the radiating area to total cross sectional area of the driver is between 0.6-0.67. In some examples, a ratio of the radiating area to total cross sectional area of the driver is between 0.62-0.65.

Figure 10A:
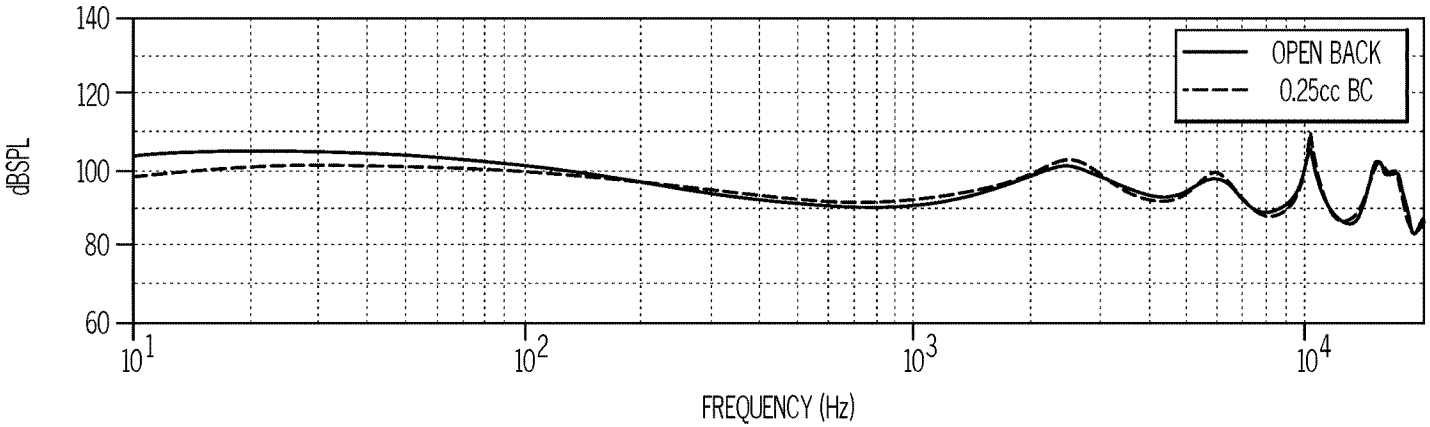
FIGS. 10A and 10B are graphs illustrating acoustic performance differences between a conventional earbud transducer and an electro-acoustic transducer shown in FIGS. 1-9.
Figure 10B:
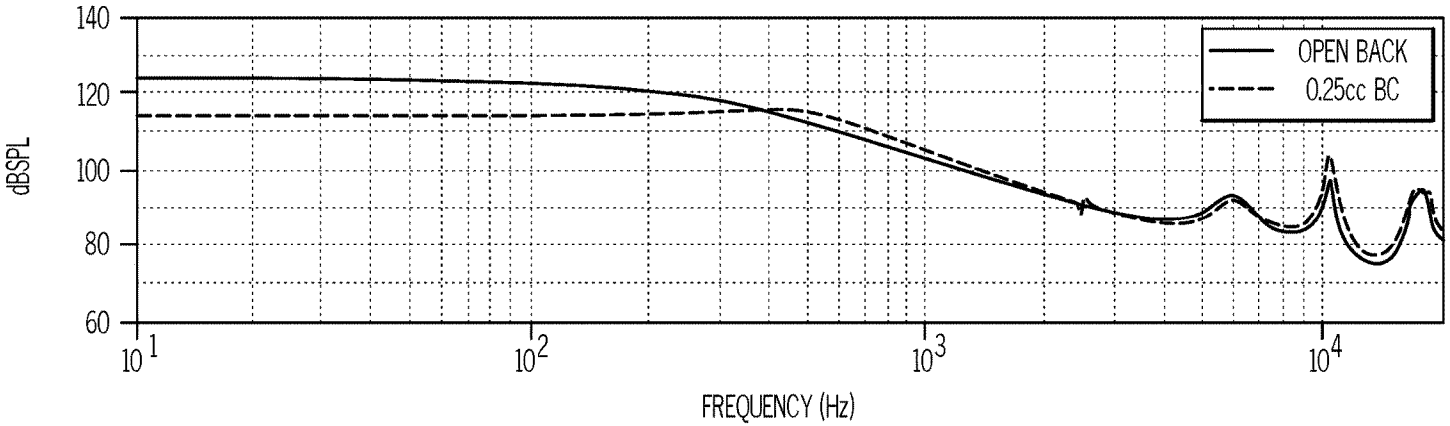

FIG. 10B is a graph illustrating the acoustic performance of electroacoustic transducer 20 of FIGS. 1-5 or electroacoustic transducer 200 of FIGS. 6-9, which may be constructed according to one of the abovementioned sizes. FIG. 10A is a graph illustrating the acoustic performance of a conventional larger earbud transducer. In particular, FIG. 10B illustrates an improved sound pressure level (db SPL) over that shown in FIG. 10A. As shown, a feature of a freely suspended lead-out, i.e., helical lead-out freely extending from the voice coil 35 to the sleeve 22 without any bonding points therebetween, provides for the ability to achieve a longer stroke which is clearly shown in FIG. 10B, which illustrates the superior low frequency performance and higher output as compared to the performance of a conventional transducer as shown in FIG. 10A.

The above and further advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

A number of implementations have been described. Nevertheless, it will be understood that the foregoing description is intended to illustrate and not to limit the scope of the inventive concepts which are defined by the scope of the claims. Other examples are within the scope of the following claims.

What is claimed is:

1. An electro-acoustic driver, comprising:

a sleeve having a first end and a second end;

a first wire exit opening at a first position of the sleeve;

a second wire exit opening at a second position of the sleeve;

a voice coil within the sleeve;

a magnetic assembly in magnetic communication with the voice coil in the sleeve between the first end and the second end; and a conductive wire of the voice coil having a first region at the first wire exit opening, a second region at the voice coil, and a third region between the first and second regions configured as a helix about the acoustic assembly, the third region of the conductive wire being substantially unsupported between the voice coil and the first wire exit opening.

2. The electro-acoustic driver of claim 1, further comprising:

a diaphragm covering the first end of the sleeve, wherein the acoustic assembly includes:

a bobbin in communication with the diaphragm; and a third region of the voice coil conductive wire about the bobbin in the sleeve.

3. The electro-acoustic driver of claim 1, wherein the first and second regions of the conductive wire are above the voice coil in the sleeve.

4. The electro-acoustic driver of claim 1, wherein the first wire exit recess and the second exit wire recess are 180 degrees from each other such that the first region and the second region of the conductive wire extend along a same axis.

5. The electro-acoustic driver of claim 1, wherein the sleeve and the acoustic assembly are positioned about an axis, and wherein the sleeve is constructed for rotation about the axis to form the helix.

6. The electro-acoustic driver of claim 1, wherein the first and second regions are unsupported from the third region of the voice coil conductive wire to the sleeve.

7. The electro-acoustic driver of claim 1, wherein the first region of the voice coil conductive wire includes a first point, a second point, and a third point, wherein the third point is at the first wire exit recess, and wherein the first region is helical from the first point to the third point, and linear from the third point to the second point, and wherein the second region of the voice coil conductive wire includes a first point, a second point, and a third point, wherein the third point is at the second wire exit recess, and wherein the second region is helical from the first point to the third point, and linear from the third point to the second point.

8. The electro-acoustic driver of claim 1, wherein one of the first and second regions of the conductive wire includes a bend such that the one of the first and second regions extends in along a helical path in a different direction than that of the other of the first and second regions.

9. An electro-acoustic driver, comprising:

a sleeve having a first end and a second end;

a voice coil within the sleeve;

a magnetic assembly in magnetic communication with the voice coil in the sleeve between the first end and the second end;

a mandrel element about a portion of the magnetic assembly; and a conductive wire extending from the voice coil, the conductive wire being substantially (a) in the shape of a helix between the voice coil and the mandrel element, and (b) unsupported between the voice coil and the mandrel element.

10. The electro-acoustic driver of claim 9, further comprising:

a diaphragm covering the first end of the sleeve, wherein the acoustic assembly includes:

a bobbin in communication with the diaphragm; and the voice coil including a third region about the bobbin in the sleeve.

11. The electro-acoustic driver of claim 9, wherein the first and second regions of the conductive wire are below the voice coil in the sleeve.

12. The electro-acoustic driver of claim 9, wherein the acoustic assembly includes a back plate having a first opening for receiving the first region of the conductive wire and a second opening for receiving the second region of the conductive wire.

13. The electro-acoustic driver of claim 9, further comprising a circuit board coupled to the second end of the sleeve, wherein the first and second regions of the conductive wire extend to the circuit board.

14. The electro-acoustic driver of claim 9, wherein the first and second regions are unsupported from a third region of the voice coil conductive wire to the mandrel element.

15. The electro-acoustic driver of claim 9, wherein the first region of the voice coil conductive wire includes a first point, a second point, and a third point, wherein the third point is at the mandrel element, and wherein the first region is helical from the first point to the third point, and linear from the third point to the second point, and wherein the second region of the voice coil conductive wire includes a first point, a second point, and a third point, wherein the third point is at the mandrel element, and wherein the second region is helical from the first point to the third point, and linear from the third point to the second point.

16. A method for assembling an electro-acoustic driver, comprising:

positioning a voice coil within a sleeve, the sleeve including a first wire exit opening at a first position of a sleeve and a second wire exit opening at a second position of the sleeve;

positioning a magnetic assembly in the sleeve between the first end and the second end; and arranging a conductive wire of the voice coil as a helix about the magnetic assembly between the voice coil and the first wire exit opening, the helical conductive wire being substantially unsupported between the voice coil and the first wire exit opening.

17. The method of claim 16, wherein the first wire exit recess and the wire exit recess are 180 degrees from each other at the first end of the sleeve.

18. The method of claim 16, wherein arranging the conductive wire about the acoustic assembly comprises:

rotating the sleeve to a predetermined position relative to the voice coil in a first direction about an axis along which the sleeve extends; and forming the helix from the conductive wire in response to rotating the sleeve.

19. The method of claim 18, wherein the first and second regions are at the predetermined position, and wherein the method further comprises: rotating the sleeve past the predetermined position so that the first and second regions of the conductive wire each extends tangentially relative to the sleeve.

20. The method of claim 19, further comprising rotating the sleeve in a second direction opposite the first direction until the first and second regions are at the predetermined position.

21. The method of claim 20, wherein after rotating the sleeve in the second direction includes rotating the sleeve at a smaller amount of rotation than a rotation of the sleeve in the first direction.

22. The method of claim 19, wherein the first and second regions are at a first angle relative to the sleeve when extended tangentially relative to the sleeve, and wherein the first and second regions are at a second angle greater than the first angle when the first and second regions are at the predetermined position.

23. The method of claim 19, wherein the first and second regions are co-linear at the predetermined position.

24. The method of claim 16, further comprising:

coupling an alignment tool to the second end of the sleeve; and holding the alignment tool in a stationary position and rotating the sleeve about the stationary alignment tool.

25. A method for forming an electro-acoustic driver, comprising:

positioning a voice coil within a sleeve;

positioning a magnetic assembly including a mandrel element in the sleeve between a first end and a second end of the sleeve; and arranging a conductive wire of the voice coil as a helix about the magnetic assembly between the voice coil and the mandrel.

26. The method of claim 25, wherein arranging the conductive wire of the voice coil as a helix includes:

translating the acoustic assembly in a direction of the voice coil in the sleeve; and rotating the acoustic assembly to form the helix.

* * * * *